US012396483B2

(12) United States Patent
Batista et al.

(10) Patent No.: US 12,396,483 B2
(45) Date of Patent: Aug. 26, 2025

(54) AEROSOL-GENERATING DEVICE WITH SENSORIAL MEDIA CARTRIDGE

(71) Applicant: PHILIP MORRIS PRODUCTS S.A., Neuchatel (CH)

(72) Inventors: Rui Nuno Batista, Morges (CH); Ricardo Cali, Mannheim (DE); Daria Tzimoulis, La Croix-sur-Lutry (DE); Adela Sahraoui, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 403 days.

(21) Appl. No.: 17/792,240

(22) PCT Filed: Jan. 22, 2021

(86) PCT No.: PCT/EP2021/051498

§ 371 (c)(1),
(2) Date: Jul. 12, 2022

(87) PCT Pub. No.: WO2021/151800

PCT Pub. Date: Aug. 5, 2021

(65) Prior Publication Data

US 2023/0051230 A1 Feb. 16, 2023

(30) Foreign Application Priority Data

Jan. 30, 2020 (EP) ..... 20386006

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/44* (2020.01); *A24F 40/465* (2020.01)

(58) Field of Classification Search
None
See application file for complete search history.

(56) References Cited

U.S. PATENT DOCUMENTS 10,212,964 B2 2/2019 Karles
11,291,783 B2 4/2022 Fraser
(Continued)

FOREIGN PATENT DOCUMENTS

CA 3079629 5/2019
CN 203828071 9/2014
(Continued)

OTHER PUBLICATIONS

PCT Search Report and Written Opinion for PCT/EP2021/051498 dated Apr. 14, 2021 (14 pages).
(Continued)

*Primary Examiner* — Philip Y Louie
*Assistant Examiner* — John Mitchell Martin
(74) *Attorney, Agent, or Firm* — Mueting Raasch Group

(57) ABSTRACT

The invention relates to an aerosol-generating device (10) comprising a top portion (20), a main portion (70), and a cartridge (50). The top portion comprises a proximal end comprising a cavity (22) for receiving an aerosol-generating article (12). The top portion further comprises a distal end comprising a top cartridge connector (24) and a top airflow channel extending from the top cartridge connector to the cavity. The main portion comprises a proximal end comprising a main cartridge connector (72). The main portion furthers comprises a main air inlet and a main airflow channel extending from the main air inlet to the main cartridge connector. The top cartridge connector is removably attachable to a proximal end of the cartridge and the main cartridge connector is removably attachable to a distal end of the cartridge enabling a first mode of operation. The
(Continued)

top cartridge connector is directly removably attachable to the main cartridge connector enabling a second mode of operation.

22 Claims, 7 Drawing Sheets

(51) Int. Cl.
*A24F 40/44* (2020.01)
*A24F 40/465* (2020.01)

(56) References Cited

U.S. PATENT DOCUMENTS

| | | | | |
|---|---|---|---|---|
| 11,477,861 | B2 | 10/2022 | Mironov | |
| 2016/0089508 | A1* | 3/2016 | Smith | A61M 15/0085 128/202.21 |
| 2017/0071251 | A1 | 3/2017 | Goch | |
| 2017/0280777 | A1* | 10/2017 | Manca | H05B 3/265 |
| 2018/0146711 | A1* | 5/2018 | Mazur | A61M 15/0028 |
| 2018/0177233 | A1 | 6/2018 | Tucker | |
| 2018/0220707 | A1* | 8/2018 | Biel | A24F 40/40 |
| 2018/0295882 | A1* | 10/2018 | Ricketts | A24F 40/42 |
| 2020/0138098 | A1 | 5/2020 | Mironov | |
| 2022/0408820 | A1* | 12/2022 | Park | A24F 40/465 |
| 2023/0204019 | A1 | 6/2023 | Phillips | |

FOREIGN PATENT DOCUMENTS

| | | |
|---|---|---|
| EP | 0845220 | 6/1998 |
| JP | 2019-505179 | 2/2019 |
| JP | 2019-522475 | 8/2019 |
| KR | 2019-0034260 | 4/2019 |
| KR | 2019-0141012 | 12/2019 |
| RU | 2606866 | 1/2017 |
| WO | WO 2018/114261 | 6/2018 |
| WO | WO 2018/189195 | 10/2018 |

OTHER PUBLICATIONS

Office Action issued in Russia for Application No. 2022123022 dated Jan. 18, 2023 (4 pages). English translation included.
Office Action issued in Japan for Application No. 2022-546129 dated Jun. 26, 2023 (2 pages).
Office Action issued in Korea for Application No. 10-2022-7025241 dated Sep. 14, 2024 (13 pages). English translation included.

* cited by examiner

AEROSOL-GENERATING DEVICE WITH SENSORIAL MEDIA CARTRIDGE

This application is a U.S. National Stage Application of International Application No. PCT/EP2021/051498 filed Jan. 22, 2021, which was published in English on Aug. 5, 2021, as International Publication No. WO 2021/151800 A1. International Application No. PCT/EP2021/051498 claims priority to European Application No. 20386006.9 filed Jan. 30, 2020.

The present disclosure relates to an aerosol-generating device. The present disclosure further relates to a cartridge for use with the aerosol-generating device. The present disclosure further relates to an aerosol-generating system comprising the aerosol-generating device and an aerosol-generating article.

It is known to provide an aerosol-generating device for generating an inhalable aerosol or vapor. Such devices may heat an aerosol-forming substrate to a temperature at which one or more components of the aerosol-forming substrate are volatilised without burning the aerosol-forming substrate. The aerosol-forming substrate may be provided as part of an aerosol-generating article. The aerosol-generating article may have a rod shape for insertion of the aerosol-generating article into a cavity, such as a heating chamber, of the aerosol-generating device. A heating element may be arranged in or around the heating chamber for heating the aerosol-forming substrate once the aerosol-generating article is inserted into the heating chamber of the aerosol-generating device.

It would be desirable to have an aerosol-generating device, in which the user experience is modifiable. It would be desirable to have an aerosol-generating device, in which the user experience is modifiable by the user. It would be desirable to have an aerosol-generating device, in which the user experience is more easily modifiable. It would be desirable to have an aerosol-generating device, in which the flavor of the generated aerosol is modifiable. It would be desirable to have an aerosol-generating device, in which the nicotine-content of the generated aerosol is modifiable. It would be desirable to have an aerosol-generating device in which the user may choose whether to generate aerosol from a solid or a liquid aerosol-generating source. It would be desirable to have an aerosol-generating device in which the user may use the device with or without a removable cartridge, which may contain a liquid. In embodiments, the liquid may contain a flavorant, an active ingredient such as nicotine, or water for humidifying the aerosol.

According to an embodiment there is provided an aerosol-generating device comprising a top portion and a main portion. The top portion may comprise a top housing. The top portion may further comprise a heating element. The top portion may further comprise a proximal end comprising a cavity for receiving an aerosol-generating article. The top portion may have a removable mouthpiece removably attachable to the proximal end of the top portion. The top portion may further comprise a distal end comprising a top cartridge connector. The top portion may further comprise a top airflow channel extending from the top cartridge connector to the cavity. The top airflow channel may extend through the top cartridge connector.

The main portion may comprise a main housing. The main portion may further comprise a power supply, preferably a battery. The main portion may further comprise a proximal end comprising a main cartridge connector. The main portion may further comprise a main air inlet. The main portion may further comprise a main airflow channel extending from the main air inlet to the main cartridge connector. The top cartridge connector may be removably attachable to a proximal end of a cartridge and the main cartridge connector may be removably attachable to a distal end of a cartridge enabling a first mode of operation wherein a cartridge is engaged between the top portion and the main portion and wherein the airflow path flows from the main air inlet through the cartridge to the cavity. The top cartridge connector may be directly removably attachable to the main cartridge connector enabling a second mode of operation, wherein the top portion is directly attached to the main portion.

According to an embodiment of the invention there is provided an aerosol-generating device comprising a top portion and a main portion. The top portion comprises a top housing. The top portion further comprises a heating element. The top portion further comprises a proximal end comprising a cavity for receiving an aerosol-generating article. The top portion may further comprise a removable mouthpiece. The top portion further comprises a distal end comprising a top cartridge connector. The top portion further comprises a top airflow channel extending from the top cartridge connector to the cavity. The main portion comprises a main housing. The main portion further comprises a power supply, preferably a battery. The main portion further comprises a proximal end comprising a main cartridge connector. The main portion further comprises a main air inlet. The main portion further comprises a main airflow channel extending from the main air inlet to the main cartridge connector. The top cartridge connector is removably attachable to a proximal end of a cartridge and the main cartridge connector is removably attachable to a distal end of a cartridge enabling a first mode of operation wherein a cartridge is engaged between the top portion and the main portion. The top cartridge connector is directly removably attachable to the main cartridge connector enabling a second mode of operation wherein the top portion is directly attached to the main portion.

The top cartridge connector may be directly removably attachable to the main cartridge connector according to the second mode of operation by means of a magnetic connection or a screw connection.

According to the first mode of operation, the device may be used with a cartridge being attached to the aerosol-generating device and with an aerosol-generating article being received in the cavity. Therefore, an inhalable aerosol may contain a mixture of substances derived from both a liquid sensorial media comprised in a liquid storage portion of the cartridge and an aerosol-forming substrate comprised in the aerosol-generating article.

Alternatively, according to the first mode of operation, the device may be used with a cartridge being attached to the aerosol-generating device, but without an aerosol-generating article being received in the cavity. Therefore, an inhalable aerosol may contain substances derived from the liquid sensorial media comprised in a liquid storage portion of the cartridge, only.

According to the second mode of operation, the device may be used without a cartridge being attached to the aerosol-generating device, but with an aerosol-generating article being received in the cavity. Therefore, an inhalable aerosol may contain substances derived from the aerosol-forming substrate comprised in the aerosol-generating article, only.

The aerosol-generating device of the invention provides a multi-functional device by enabling different modes of operation. A user may choose between the different modes of operation. Thus, it is not necessary for a user to carry multiple different devices for each mode of operation, but only one device. Also, a user may not need to buy multiple different devices, but only one device, which may be cost saving.

By means of enabling the different modes of operation, the user experience is modifiable. By means of enabling the different modes of operation, the user experience is modifiable by the user. By means of enabling the different modes of operation, the user experience is more easily modifiable. By means of enabling the different modes of operation, the flavor of the generated aerosol is modifiable. By means of enabling the different modes of operation, the nicotine-content of the generated aerosol is modifiable.

The proximal end of the top portion may be adapted to allow attachment of a mouthpiece when no aerosol-generating article is received in the cavity enabling a third mode of operation. Therefore, an inhalable aerosol may contain substances derived from the liquid sensorial media comprised in a liquid storage portion of the cartridge, only. The additional mouthpiece may allow further modification of the airflow to be inhaled by a user. For example, the aerosol may be further modified by additional air apertures in the mouthpiece which further dilute the aerosol.

The device may further comprise a mouthpiece. The mouthpiece may be removably attachable to the proximal end of the top portion of the aerosol-generating device when no aerosol-generating article is received in the cavity.

The aerosol-generating device may be configured to removably attach the cartridge. Thereby, the cartridge may be easily replaced by the user. The user may replace an emptied cartridge. The user may select between different cartridges holding different liquids. The different cartridges may be colour-coded with different colours such that the user may easily distinguish between the different liquids.

A wall of a cartridge may be one or more of a wall of a housing of the cartridge, a wall of the liquid storage portion, or a wall of a liquid storage compartment of the liquid storage portion. A wall of a cartridge may be transparent such that the liquid contained in the liquid storage portion may be visible from the outside. A user may distinguish between different liquids based on a colour of the liquid. A wall of a cartridge may be transparent such that emptying of the liquid storage portion may be visible from the outside.

The cavity of the aerosol-generating device may have an open end into which the aerosol-generating article is inserted. The open end may be a proximal end. The cavity may have a closed end opposite the open end. The closed end may be the base of the cavity. The closed end may be closed except for the provision of air apertures arranged in the base. The base of the cavity may be flat. The base of the cavity may be circular. The base of the cavity may be arranged upstream of the cavity. The open end may be arranged downstream of the cavity. The cavity may have an elongate extension. The cavity may have a longitudinal central axis. A longitudinal direction may be the direction extending between the open and closed ends along the longitudinal central axis. The longitudinal central axis of the cavity may be parallel to the longitudinal axis of the aerosol-generating device.

The cavity may be configured as a heating chamber. The cavity may have a cylindrical shape. The cavity may have a hollow cylindrical shape. The cavity may have a shape corresponding to the shape of the aerosol-generating article to be received in the cavity. The cavity may have a circular cross-section. The cavity may have an elliptical or rectangular cross-section. The cavity may have an inner diameter corresponding to the outer diameter of the aerosol-generating article.

The cavity may be adapted such that air may flow through the cavity. The top airflow channel may extend into the cavity. The liquid storage portion of a cartridge may be fluidly connected with the cavity via the top airflow channel. Ambient air may be drawn into the aerosol-generating device, into the cavity and towards the user. The open end of the cavity may comprise the air outlet. Downstream of the cavity, a mouthpiece may be arranged or a user may directly draw on the aerosol-generating article. The airflow channel may extend through the mouthpiece.

The top portion may comprise a top air inlet, and an additional airflow channel extending from the top air inlet to the cavity.

The aerosol-generating device may comprise a housing. The top portion may comprise a top housing and the main portion may comprise a main housing. The top housing and the main housing may be separate elements.

The top portion may comprise a heating element and the main portion may comprise a power supply for powering the heating element. The power supply may comprise a battery. The power supply may be a lithium-ion battery. Alternatively, the power supply may be a nickel-metal hydride battery, a nickel cadmium battery, or a lithium-based battery, for example a lithium-cobalt, a lithium-iron-phosphate, lithium titanate or a lithium-polymer battery. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

The power supply may be a direct current (DC) power supply. In one embodiment, the power supply is a DC power supply having a DC supply voltage in the range of 2.5 Volts to 4.5 Volts and a DC supply current in the range of 1 Amp to 10 Amps (corresponding to a DC power supply in the range of 2.5 Watts to 45 Watts). The aerosol-generating device may advantageously comprise a direct current to alternating current (DC/AC) inverter for converting a DC current supplied by the DC power supply to an alternating current. The DC/AC converter may comprise a Class-D, Class-C or Class-E power amplifier. The AC power output of the DC/AC converter is supplied to the induction coil.

The power supply may be adapted to power an induction coil and may be configured to operate at high frequency. A Class-E power amplifier is preferable for operating at high frequency. As used herein, the term 'high frequency oscillating current' means an oscillating current having a frequency of between 500 kilohertz and 30 megahertz. The high frequency oscillating current may have a frequency of from 1 megahertz to 30 megahertz, preferably from 1 megahertz to 10 megahertz, and more preferably from 5 megahertz to 8 megahertz.

In another embodiment the switching frequency of the power amplifier may be in the lower kHz range, e.g. between 100 kHz and 400 KHz. In the embodiments, where a Class-D or Class-C power amplifier is used, switching frequencies in the lower kHz range are particularly advantageous.

The heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and superalloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The heating element advantageously heats the aerosol-forming substrate by means of heat conduction. The heating element may be at least partially in contact with the substrate, or the carrier on which the substrate is deposited. Alternatively, the heat from either an internal or external heating element may be conducted to the substrate by means of a heat conductive element.

During operation, the aerosol-forming substrate may be completely contained within the aerosol-generating device. In that case, a user may puff on a mouthpiece of the aerosol-generating device. Alternatively, during operation a smoking article containing the aerosol-forming substrate may be partially contained within the aerosol-generating device. In that case, the user may puff directly on the smoking article.

The heating element of the aerosol-generating device may comprise a resistive heating element. The heating element of the top portion may comprise a resistive heating element. The heating element of the aerosol-generating device may comprise an induction heating element. The heating element of the top portion may comprise an induction heating element.

The induction heating element may be configured to generate heat by means of induction. The induction heating element may comprise an induction coil and a susceptor arrangement. A single induction coil may be provided. A single susceptor arrangement may be provided. Preferably, more than a single induction coil is provided. A first induction coil and a second induction coil may be provided. Preferably, more than a single susceptor arrangement is provided. The induction heating element may comprise a central susceptor arrangement and a peripheral susceptor arrangement.

The central susceptor arrangement may be a tubular susceptor. The induction heating element may comprise a peripheral induction coil and a tubular susceptor. The tubular susceptor may circumscribe at least a portion of the top airflow channel.

The peripheral susceptor arrangement may be an additional tubular susceptor. The additional tubular susceptor may circumscribe at least a portion of the cavity.

The induction heating element may comprise a peripheral induction coil, a tubular susceptor, and an additional tubular susceptor. The induction coil, the tubular susceptor, and the additional tubular susceptor may be coaxially aligned.

The central susceptor arrangement may comprise a central susceptor. The central susceptor arrangement may comprise at least two central susceptors. The central susceptor arrangement may comprise more than two central susceptors. The central susceptor arrangement may comprise four central susceptors. The central susceptor arrangement may consist of four central susceptors. At least one of, preferably all, of the central susceptor(s) may be elongate.

The central susceptor may be arranged parallel to the longitudinal central axis of the cavity. If multiple central susceptors are provided, each central susceptor may be arranged equidistant parallel to the longitudinal central axis of the cavity.

A downstream end portion of the central susceptor arrangement may be rounded, preferably bend inwards towards the central longitudinal axis of the cavity. A downstream end portion of the central susceptor may be rounded, preferably bend inwards towards the central longitudinal axis of the cavity. If multiple central susceptors are provided, preferably each downstream end portion of each central susceptor may be rounded, preferably bend inwards towards the central longitudinal axis of the cavity. The rounded end portion may facilitate insertion of the aerosol-generating article over the central susceptor arrangement. Alternatively to a rounded end portion, the end portion may be tapered or chamfered towards the longitudinal central axis of the cavity.

The central susceptor arrangement may be arranged around the central longitudinal axis of the cavity. If multiple central susceptors are provided, the central susceptors may be arranged in a ring-shaped orientation around the central longitudinal axis of the cavity. When the aerosol-generating article is inserted into the cavity, the aerosol-generating article may be centred in the cavity by means of the arrangement of the central susceptor arrangement.

The central susceptor arrangement may be hollow. The central susceptor arrangement may comprise at least two central susceptors defining a hollow cavity between the central susceptors. The hollow configuration of the central susceptor arrangement may enable airflow into the hollow central susceptor arrangement. The top airflow channel may extend through the hollow central susceptor arrangement. A wick may be provided within the hollow central susceptor arrangement. As described herein, preferably the central susceptor arrangement comprises at least two central susceptors. Preferably, gaps are provided between the at least two central susceptors. As a consequence, airflow may be enabled through the central susceptor arrangement. The airflow may be enabled in a direction parallel or along the longitudinal central axis of the cavity. Preferably, by means of the gap, airflow may be enabled in a lateral direction. Lateral airflow may enable aerosol generation due to contact between the incoming air and the aerosol-generating substrate of the aerosol-generating article through the gaps between the central susceptors. Heating of the central susceptor arrangement may lead to heating of a wick provided within the hollow central susceptor arrangement. Heating of the wick may lead to aerosol generation within the hollow central susceptor arrangement. Additionally or alternatively, heating of the central susceptor arrangement, when the aerosol-generating article is inserted into the cavity, may lead to aerosol generation within the hollow central susceptor arrangement. The central susceptor arrangement may be configured to heat the inside of the aerosol-generating article. The aerosol may be drawn in a downstream direction through the hollow central susceptor arrangement.

The central susceptor arrangement may have a ring-shaped cross-section. The central susceptor arrangement may comprise at least two central susceptors defining a hollow cavity with a ring-shaped cross-section. The central susceptor arrangement may be tubular. If the central susceptor arrangement comprises at least two central susceptors, the central susceptors may be arranged to form the tubular central susceptor arrangement. Preferably, airflow is enabled through the central susceptor arrangement through gaps between the central susceptors.

The peripheral susceptor arrangement may comprise an elongate, preferably blade-shaped susceptor, or a cylinder-shaped susceptor. The peripheral susceptor arrangement may comprise at least two blade-shaped susceptors. The blade-shaped susceptors may be arranged surrounding the cavity. The blade-shaped susceptors may be arranged parallel to the longitudinal central axis of the cavity. The blade-shaped susceptors may be arranged inside of the cavity. The blade-shaped susceptors may be arranged for holding the aerosol-generating article, when the aerosol-generating article is inserted into the cavity. The blade-shaped susceptors may have flared downstream ends to facilitate insertion of the aerosol-generating article into the blade shaped susceptors. Air may flow into the cavity between the blade-shaped susceptors. Gaps may be provided between individual blade-shaped susceptors. The air may subsequently contact or enter into the aerosol-generating article. A uniform penetration of the aerosol-generating article with air may be achieved in this way, thereby optimizing aerosol generation. The peripheral susceptor arrangement may be configured to heat the outside of the aerosol-generating article.

The peripheral susceptor arrangement may comprise at least two peripheral susceptors. The peripheral susceptor arrangement may comprise multiple peripheral susceptors. At least one of, preferably all of, the peripheral susceptors may be elongate. At least one of, preferably all of, the peripheral susceptors may be blade-shaped.

A downstream end portion of the peripheral susceptor arrangement may be flared. At least one of, preferably all of, the peripheral susceptors may have flared downstream end portions.

The peripheral susceptor arrangement may be arranged around the central longitudinal axis of the cavity. The peripheral susceptor arrangement may be arranged around the central susceptor arrangement. If the peripheral susceptor arrangement comprises multiple peripheral susceptors, each peripheral susceptor may be arranged equidistant parallel to the central longitudinal axis of the cavity.

The peripheral susceptor arrangement may define an annular hollow cylinder-shaped cavity between the peripheral susceptor arrangement and the central susceptor arrangement. The annular hollow cylinder-shaped cavity may be the cavity for insertion of the aerosol-generating article. The central susceptor arrangement may be arranged in the annular hollow cylinder-shaped cavity. The annular hollow cylinder-shaped cavity may be configured to receive the aerosol-generating article.

The peripheral susceptor may have a ring-shaped cross-section. The peripheral susceptor arrangement may comprise at least two peripheral susceptors defining a hollow cavity with a ring-shaped cross section. The peripheral susceptor arrangement may be tubular.

The peripheral susceptor arrangement may have an inner diameter larger than an outer diameter of the central susceptor arrangement. Between the peripheral susceptor arrangement and the central susceptor arrangement, the annular hollow cylinder-shaped cavity may be arranged.

The central susceptor arrangement and the peripheral susceptor arrangement may be coaxially arranged.

The induction coil may surround both the central susceptor arrangement and the peripheral susceptor arrangement. The first induction coil may surround a first region of the central and peripheral susceptor arrangements. The second induction coil may surround a second region of the central and peripheral susceptor arrangements. A region surrounded by an induction coil may be configured as a heating zone as described in more detail below.

The aerosol-generating device may comprise a flux concentrator. The flux concentrator may be made from a material having a high magnetic permeability. The flux concentrator may be arranged surrounding the induction heating element. The flux concentrator may concentrate the magnetic field lines to the interior of the flux concentrator thereby increasing the heating effect of the susceptor arrangement by means of the induction coil, and prevent the alternating magnetic field from the inductor to interfere with other devices in the surroundings.

The aerosol-generating device may comprise a controller. The controller may be electrically connected to the induction coil. The controller may be electrically connected to the first induction coil and to the second induction coil. The controller may be configured to control the electrical current supplied to the induction coil(s), and thus the magnetic field strength generated by the induction coil(s).

The power supply and the controller may be connected to the induction coil.

The controller may be configured to be able to chop the current supply on the input side of the DC/AC converter. This way the power supplied to the induction coil may be controlled by conventional methods of duty-cycle management.

Both the top cartridge connector and the main cartridge connector may comprise electrically conductive elements being adapted to establish electric contact between the top portion and the main portion when the top cartridge connector is directly attached to the main cartridge connector according to the second mode of operation. Alternatively or in addition, both the top cartridge connector and the main cartridge connector may comprise electrically conductive elements being adapted to establish electric contact between the top portion and the main portion when the top cartridge connector is attached to a proximal end of a cartridge and the main cartridge connector is attached to a distal end of a cartridge according to the first mode of operation.

The top portion may comprise a wick being arranged at least partly within the top airflow channel. The wick may be arranged spaced from the distal end of the top airflow channel.

The wick may be arranged spaced from the top cartridge connector. The wick may be arranged spaced from a liquid storage portion of a cartridge, when the top cartridge connector is connected to a cartridge. The wick may thus be arranged not to be in contact with the liquid being contained in the liquid storage portion. Accordingly, in the absence of a pressure drop in the top airflow channel at the top cartridge connector, substantially no liquid is transported from the liquid storage portion to the wick. In the absence of a pressure drop in the top airflow channel at the top cartridge connector, liquid leakage out of the liquid storage portion is reduced or prevented.

A pressure drop in the top airflow channel may be caused by a user drawing on an air outlet of the aerosol-generating device. The pressure drop may cause an airflow in the top airflow channel. The pressure drop may thus cause liquid to be transported from the liquid storage portion to the wick past the liquid outlet of the cartridge and past the top cartridge connector of the top portion via the airflow.

By the separation of the wick and the liquid storage portion, the wick may only absorb liquid from the airflow upon a user drawing on the air outlet. Absorption of liquid by the wick may be advantageously controlled. Also, surplus absorption of liquid by the wick may be reduced. Absorption of liquid by the wick during inactivity of the device may be reduced. Thereby, unwanted off-tastes may be prevented or diminished. Leakage of liquid aerosol-generating substrate may be prevented or diminished. Contamination of the device may thus be prevented or diminished.

The wick may be a porous element. The wick may be capable of absorbing liquid from the airflow. The wick may comprise a capillary material. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, ethylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary material by capillary action. The capillary material may be configured to convey the aerosol-forming substrate to the heating element. The capillary material may extend into interstices in the heating element.

The main portion may comprise a high retention material being arranged in proximity to the main cartridge connector for absorbing potential leaks of a cartridge. The high retention material may comprise one or more absorbing materials. The high retention material may comprise a sponge-like or foam-like material. The high retention material may comprise one or more of a zeolite, anhydrous calcium chloride, soda lime, silica gel, activated carbon, and superabsorbent polymers.

According to an embodiment of the invention there is provided a cartridge for use with an aerosol-generating device. The cartridge may comprise a proximal end comprising a liquid outlet and being removably attachable to the top cartridge connector of the top portion of an aerosol-generating device as described herein. The cartridge may further comprise a distal end comprising an air inlet and being removably attachable to the main cartridge connector of the main portion of an aerosol-generating device as described herein. The cartridge may further comprise a liquid storage portion arranged between the proximal end and the distal end, such that when the cartridge is attached to both the top portion and the main portion, a continuous fluid connection is provided along the main and top airflow channels from the main air inlet to the cavity via the liquid storage portion of the cartridge.

According to an embodiment of the invention there is provided a cartridge for use with an aerosol-generating device. The cartridge comprises a proximal end comprising a liquid outlet and being removably attachable to the top cartridge connector of the top portion of an aerosol-generating device as described herein. The cartridge further comprises a distal end comprising an air inlet and being removably attachable to the main cartridge connector of the main portion of an aerosol-generating device as described herein. The cartridge further comprises a liquid storage portion arranged between the proximal end and the distal end, such that when the cartridge is attached to both the top portion and the main portion, a continuous fluid connection is provided along the main and top airflow channels from the main air inlet to the cavity via the liquid storage portion of the cartridge.

The cartridge may be substantially sealed. The cartridge may comprise one or more liquid outlets for liquid sensorial media stored in the liquid storage portion to flow from the liquid storage portion to other parts of the aerosol-generating device. The cartridge may comprise one or more semi-open inlets. This may enable ambient air to enter the cartridge and the liquid storage portion. The one or more semi-open inlets may be semi-permeable membranes or one-way valves, permeable to allow ambient air into the liquid storage portion and impermeable to substantially prevent air and liquid inside the liquid storage portion from leaving the liquid storage portion. The one or more semi-open inlets may enable air to pass into the liquid storage portion under specific conditions. The liquid storage portion of the cartridge may be refillable. Alternatively, the cartridge may be configured as a replaceable cartridge. A new cartridge may be attached to the aerosol-generating device when the initial cartridge is spent.

The liquid outlet of the proximal end of the cartridge may comprise a one-way valve. The one-way valve may be configured to open in response to a pressure drop in the top airflow channel. The one-way valve may further prevent contamination of the liquid storage portion by hindering any residues from entering into the liquid storage portion via the liquid outlet.

The air inlet of the distal end of the cartridge may comprise a one-way valve. The one-way valve may be configured to open in response to a pressure drop in the main airflow channel. The one-way valve may further prevent leakage of liquid out of the air inlet at the distal end of the cartridge.

The liquid storage portion may comprise a liquid sensorial media. The liquid sensorial media may comprise a flavorant. The liquid sensorial media may comprise nicotine.

The liquid storage portion of the cartridge may comprise two or more individual liquid storage compartments. Each liquid storage compartment may comprise a liquid comprising a liquid sensorial media. The individual liquid storage compartments may comprise identical liquids. Alternatively, at least one liquid storage compartment may comprise a liquid composition which differs from a liquid composition of another liquid storage compartment. At least one liquid storage compartment may comprise a liquid sensorial media which differs from a liquid sensorial media of another liquid storage compartment.

Each liquid storage compartment may have an individual compartment air inlet and an individual compartment liquid outlet. The cartridge may comprise means for one or both of individually opening and individually closing one or both of the compartment air inlet and the compartment liquid outlet.

The liquid storage portion may comprise two or more series-connected liquid storage compartments. The liquid storage portion may comprise two or more series-connected liquid storage compartments such that, when the cartridge is attached to both the top portion and the main portion, a continuous fluid connection is provided along the main and top airflow channels from the main air inlet to the cavity via the liquid storage portion of the cartridge, wherein the fluid connection is provided subsequently through the two or more series-connected liquid storage compartments of the liquid storage portion of the cartridge.

The liquid storage portion may comprise two or more parallel-connected liquid storage compartments. The liquid storage portion may comprise two or more parallel-connected liquid storage compartments such that, when the cartridge is attached to both the top portion and the main portion, a continuous fluid connection is provided along the main and top airflow channels from the main air inlet to the cavity via one of the parallel-connected liquid storage compartments of the liquid storage portion of the cartridge. Alternatively, the liquid storage portion may comprise two or more parallel-connected liquid storage compartments such that, when the cartridge is attached to both the top portion and the main portion, a continuous fluid connection is provided along the main and top airflow channels from the main air inlet to the cavity via at least two of the parallel-connected liquid storage compartments of the liquid storage portion of the cartridge.

The liquid storage portion may be configured such that the user may choose between the two or more parallel-connected liquid storage compartments to provide the fluid connection and to participate in the aerosol generation. A user may thus choose between different liquid sensorial media stored in the different parallel-connected liquid storage compartments. A cartridge may be provided which can be used in different configurations generating different types of aerosols.

Alternatively or in addition, an aerosol being modified by a superimposition of different liquid sensorial media from different liquid storage compartments may be generated. For example, different liquid sensorial media comprising different flavorants may be used in different liquid storage compartments. A user may thus create a specific flavour combining different flavorants by selecting a specific combination of liquid storage compartments to participate in aerosol-generation.

The liquid storage portion of the cartridge may comprise both parallel-connected and series-connected liquid storage compartments.

By means of the parallel-connected liquid storage compartments and, alternatively or in addition, the series-connected liquid storage compartments various different types and configurations of cartridges may be selected.

By means of the different types and configurations of cartridges, the user experience is modifiable. By means of the different types and configurations of cartridges, the user experience is modifiable by the user. By means of the different types and configurations of cartridges, the user experience is more easily modifiable. By means of the different types and configurations of cartridges, the flavor of the generated aerosol is modifiable. By means of the different types and configurations of cartridges, the nicotine-content of the generated aerosol is modifiable.

The cartridge may comprise electrically conductive elements being adapted to establish electric contact between the top portion and the main portion when the cartridge is attached to both the top portion and the main portion. The electrically conductive elements may connect the heating element in the top portion to one or both of a controller and a power supply in the main portion.

According to an embodiment of the invention there is provided an aerosol-generating system comprising an aerosol-generating device as described herein and an aerosol-generating article as described herein comprising an aerosol-forming substrate as described herein.

As used herein the term 'liquid sensorial media' relates to a liquid composition capable of modifying an airflow in contact with the liquid sensorial media. The modification of the airflow may be one or more of forming an aerosol or a vapor, cooling an airflow, and filtering an airflow. For example, the liquid sensorial media may comprise an aerosol-forming substrate capable of releasing volatile compounds that can form an aerosol or a vapor. Preferably, the aerosol-forming substrate in the liquid sensorial media is a flavorant or comprises a flavorant. Alternatively or in addition, the liquid sensorial media may comprise one or both of a cooling substance for cooling an airflow passing through the liquid sensorial media and a filter substance for capturing unwanted components in the airflow. Water may be used as a cooling substance. Water may be used as a filtering substance for capturing particles such as dust particles from the airflow. The liquid sensorial media may serve as one or more of a nicotine providing liquid, a flavor enhancer, and a volume enhancer.

As used herein, the term 'aerosol-forming substrate' relates to a substrate capable of releasing volatile compounds that can form an aerosol or a vapor. Such volatile compounds may be released by heating the aerosol-forming substrate. The aerosol-forming substrate may be in solid form or may be in liquid form. The terms 'aerosol' and 'vapor' are used synonymously.

The aerosol-forming substrate may be part of an aerosol-generating article. The aerosol-forming substrate may be part of the liquid held in the liquid storage portion. The aerosol-forming substrate may be part of the liquid sensorial media held in the liquid storage portion. The liquid storage portion may contain a liquid aerosol-forming substrate. Alternatively or in addition, the liquid storage portion may contain a solid aerosol-forming substrate. For example, the liquid storage portion may contain a suspension of a solid aerosol-forming substrate and a liquid. Preferably, the liquid storage portion contains a liquid aerosol-forming substrate.

The aerosol-forming substrate described in the following may be one or both of the aerosol-forming substrate contained in the liquid storage portion and the aerosol-forming substrate comprised in the aerosol-generating article. Preferably, a liquid nicotine or flavor/flavorant containing aerosol-forming substrate may be employed in the liquid storage portion of the cartridge, while a solid tobacco containing aerosol-forming substrate may be employed in the aerosol-generating article.

The aerosol-forming substrate may comprise nicotine. The nicotine-containing aerosol-forming substrate may be a nicotine salt matrix.

The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate may comprise a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from 5 percent to 30 percent by weight on a dry weight basis. The aerosol-forming substrate may comprise other additives and ingredients, such as flavourants.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the device. An aerosol-generating article may be disposable. The aerosol-generating article may be insertable into the cavity of the aerosol-generating device.

The aerosol-generating article and the cavity of the aerosol-generating device may be arranged such that the aerosol-generating article is partially received within the cavity of the aerosol-generating device. The cavity of the aerosol-generating device and the aerosol-generating article may be arranged such that the aerosol-generating article is entirely received within the cavity of the aerosol-generating device.

The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

As used herein, the term 'liquid storage portion' refers to a storage portion comprising a liquid sensorial media and, additionally or alternatively, an aerosol-forming substrate that is capable of releasing volatile compounds that can form an aerosol. The liquid storage portion may be configured as a container or a reservoir for storing the liquid aerosol-forming substrate.

The liquid storage portion may be configured as a replaceable tank or container. The liquid storage portion may be any suitable shape and size. For example, the liquid storage portion may be substantially cylindrical. The cross-section of the liquid storage portion may, for example, be substantially circular, elliptical, square or rectangular.

The liquid storage portion may comprise a housing. The housing may comprise a base and one or more sidewalls extending from the base. The base and the one or more sidewalls may be integrally formed. The base and one or more sidewalls may be distinct elements that are attached or secured to each other. The housing of the liquid storage portion may comprise a transparent or a translucent portion, such that liquid aerosol-forming substrate stored in the liquid storage portion may be visible to a user through the housing. The liquid storage portion may be configured such that aerosol-forming substrate stored in the liquid storage portion is protected from ambient air. The liquid storage portion may be configured such that aerosol-forming substrate stored in the liquid storage portion is protected from light. This may reduce the risk of degradation of the substrate and may maintain a high level of hygiene.

As used herein, the term 'aerosol-generating device' refers to a device that interacts with one or both of an aerosol-generating article and a cartridge to generate an aerosol.

As used herein, the term 'aerosol-generating system' refers to the combination of the aerosol-generating article, as further described and illustrated herein, with an aerosol-generating device, as further described and illustrated herein. In the system, the aerosol-generating device and one or both of the aerosol-generating article and the cartridge cooperate to generate a respirable aerosol.

The aerosol-generating device may comprise a thermally insulating element. The thermally insulating element may be arranged surrounding the cavity. The thermally insulating element may be arranged between a housing of the aerosol-generating device and the cavity. The thermally insulating element may be tubular. The thermally insulating element may be coaxially aligned with the induction heating element, preferably coaxially aligned with the tubular susceptor.

Preferably, the aerosol-generating device is portable. The aerosol-generating device may have a size comparable to a conventional cigar or cigarette. The device may be an electrically operated smoking device. The device may be a handheld aerosol-generating device. The aerosol-generating device may have a total length between 30 millimetres and 150 millimetres. The aerosol-generating device may have an external diameter between 5 millimetres and 30 millimetres.

The aerosol-generating device may comprise a housing. The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise at least one air inlet. The housing may comprise more than one air inlet.

As used herein, the term 'mouthpiece' refers to a portion of an aerosol-generating device that is placed into a user's mouth in order to directly inhale an aerosol generated by the aerosol-generating device from an aerosol-generating article received in the cavity of the device and/or from the liquid received in the liquid storage portion of the cartridge.

Operation of the heating element may be triggered by a puff detection system. Alternatively, the heating element may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor. When the user draws on the aerosol-generating device, a negative pressure or vacuum is generated inside the device, wherein the negative pressure may be detected by the pressure sensor. The term "negative pressure" is to be understood as a pressure which is lower than the pressure of ambient air. In other words, when the user draws on the device, the air which is drawn through the device has a pressure which is lower than the pressure off ambient air outside of the device.

The aerosol-generating device may include a user interface to activate the aerosol-generating device, for example a button to initiate heating of the aerosol-generating device or a display to indicate a state of the aerosol-generating device or of the aerosol-forming substrate.

The aerosol-generating device may include additional components, such as, for example a charging unit for recharging an on-board electric power supply in an electrically operated or electric aerosol-generating device.

As used herein, the term 'proximal' refers to a user-end, or mouth-end of the aerosol-generating device or a part or portion thereof, and the term 'distal' refers to the end opposite to the proximal end. When referring to the cavity, the term 'proximal' refers to the region closest to the open end of the cavity and the term 'distal' refers to the region closest to the closed end.

As used herein, the terms 'upstream' and 'downstream' are used to describe the relative positions of components, or portions of components, of the aerosol-generating device in relation to the direction in which a user draws on the aerosol-generating device during use thereof.

As used herein, a 'susceptor arrangement' means a element that heats up when subjected to an alternating magnetic field. This may be the result of eddy currents induced in the susceptor arrangement, hysteresis losses, or both eddy currents and hysteresis losses. During use, the susceptor arrangement is located in thermal contact or close thermal proximity with an aerosol-forming substrate received in the aerosol-generating device. In this manner, the aerosol-forming substrate is heated by the susceptor arrangement such that an aerosol is formed.

The susceptor material may be any material that can be inductively heated to a temperature sufficient to aerosolize an aerosol-forming substrate. The following examples and features concerning the susceptor arrangement may apply to one or both of the central susceptor arrangement and the peripheral susceptor arrangement. Suitable materials for the susceptor material include graphite, molybdenum, silicon carbide, stainless steels, niobium, aluminium, nickel, nickel containing compounds, titanium, and composites of metallic materials. Preferred susceptor materials comprise a metal or carbon. Advantageously the susceptor material may comprise or consists of a ferromagnetic or ferri-magnetic material, for example, ferritic iron, a ferromagnetic alloy, such as ferromagnetic steel or stainless steel, ferromagnetic particles, and ferrite. A suitable susceptor material may be, or comprise, aluminium. The susceptor material may comprise more than 5 percent, preferably more than 20 percent, more preferably more than 50 percent, or more than 90 percent of ferromagnetic, ferri-magnetic or paramagnetic materials. Preferred susceptor materials may be heated to a temperature in excess of 250 degrees Celsius without degradation.

The susceptor material may be formed from a single material layer. The single material layer may be a steel layer.

The susceptor material may comprise a non-metallic core with a metal layer disposed on the non-metallic core. For example, the susceptor material may comprise metallic tracks formed on an outer surface of a ceramic core or substrate.

The susceptor material may be formed from a layer of austenitic steel. One or more layers of stainless steel may be arranged on the layer of austenitic steel. For example, the susceptor material may be formed from a layer of austenitic steel having a layer of stainless steel on each of its upper and lower surfaces. The susceptor arrangement may comprise a single susceptor material. The susceptor arrangement may comprise a first susceptor material and a second susceptor material. The first susceptor material may be disposed in intimate physical contact with the second susceptor material. The first and second susceptor materials may be in intimate contact to form a unitary susceptor. In certain embodiments, the first susceptor material is stainless steel and the second susceptor material is nickel. The susceptor arrangement may have a two-layer construction. The susceptor arrangement may be formed from a stainless steel layer and a nickel layer.

Intimate contact between the first susceptor material and the second susceptor material may be made by any suitable means. For example, the second susceptor material may be plated, deposited, coated, clad or welded onto the first susceptor material. Preferred methods include electroplating, galvanic plating and cladding.

Features described in relation to one embodiment may equally be applied to other embodiments of the invention.

Below, there is provided a non-exhaustive list of non-limiting examples. Any one or more of the features of these examples may be combined with any one or more features of another example or embodiment described herein.

Example A: An aerosol-generating device comprising a top portion and a main portion, the top portion comprising:

a top housing, a heating element, a proximal end comprising a cavity for receiving an aerosol-generating article, a distal end comprising a top cartridge connector, and a top airflow channel extending from the top cartridge connector to the cavity;

the main portion comprising:

a main housing, a power supply, a proximal end comprising a main cartridge connector, a main air inlet, and a main airflow channel extending from the main air inlet to the main cartridge connector;

wherein the top cartridge connector is removably attachable to a proximal end of a cartridge and the main cartridge connector is removably attachable to a distal end of a cartridge enabling a first mode of operation, and the top cartridge connector is directly removably attachable to the main cartridge connector enabling a second mode of operation.

Example B: The device according to Example A, wherein the top portion comprises a top air inlet, and an additional airflow channel extending from the top air inlet to the cavity.

Example C: The device according to Example A or B, wherein the proximal end of the top portion is adapted to allow attachment of a mouthpiece when no aerosol-generating article is received in the cavity enabling a third mode of operation.

Example D: The device according to any one of the preceding examples, wherein both the top cartridge connector and the main cartridge connector comprise electrically conductive elements being adapted to establish electric contact between the top portion and the main portion when the top cartridge connector is directly attached to the main cartridge connector according to the second mode of operation.

Example E: The device according to any one of the preceding examples, wherein the heating element of the top portion comprises an induction heating element.

Example F: The device according to Example E, wherein the induction heating element comprises a peripheral induction coil and a tubular susceptor, the tubular susceptor circumscribing at least a portion of the top airflow channel.

Example G: The device according to Example F, wherein the top portion comprises a top air inlet, and an additional airflow channel extending from the top air inlet to the cavity; and wherein the induction heating element comprises an additional tubular susceptor, the additional tubular susceptor circumscribing at least a portion of the cavity.

Example H: The device according to Example G, wherein the induction coil, the tubular susceptor, and the additional tubular susceptor are coaxially aligned.

Example I: The device according to any one of the preceding examples, wherein the top portion comprises a wick being arranged at least partly within the top airflow channel, and wherein the wick is arranged spaced from the distal end of the top airflow channel.

Example J: The device according to Example I, wherein the wick is a porous element.

Example K: The device according to any one of the preceding examples, wherein the main portion comprises a high retention material being arranged in proximity to the main cartridge connector for absorbing potential leaks of a cartridge.

Example L: A cartridge for use with the device of any one of Examples A to K, the cartridge comprising

- a proximal end comprising a liquid outlet and being removably attachable to the top cartridge connector of the top portion,
- a distal end comprising an air inlet and being removably attachable to the main cartridge connector of the main portion, and
- a liquid storage portion arranged between the proximal end and the distal end, such that when the cartridge is attached to both the top portion and the main portion, a continuous fluid connection is provided along the main and top airflow channels from the main air inlet to the cavity via the liquid storage portion of the cartridge.

Example M: The cartridge according to Example L, wherein the liquid outlet of the proximal end comprises a one-way valve.

Example N: The cartridge according to Example L or Example M, wherein the air inlet of the distal end comprises a one-way valve.

Example O: The cartridge according to any one Examples L to N, wherein the liquid storage portion comprises a liquid sensorial media.

Example P: The cartridge according to Example O, wherein the liquid sensorial media comprises a flavorant.

Example Q: The cartridge according to Example O or Example P, wherein the liquid sensorial media comprises nicotine.

Example R: The cartridge according to any one of Examples L to Q, wherein the liquid storage portion comprises two or more series-connected liquid storage compartments.

Example S: The cartridge according to any one of Examples L to R, wherein the liquid storage portion comprises two or more parallel-connected liquid storage compartments.

Example T: The cartridge according to Example R or Example S, wherein at least one liquid storage compartment comprises a liquid composition which differs from a liquid composition of another liquid storage compartment.

Example U: The cartridge according to any one of Examples L to T, wherein the cartridge comprises electrically conductive elements being adapted to establish electric contact between the top portion and the main portion when the cartridge is attached to both the top portion and the main portion.

Example V: An aerosol-generating device comprising the device according to any one of Examples A to K and the cartridge according to any one of Examples L to U.

Example W: The device according to Example V further comprising a mouthpiece, wherein the mouthpiece is removably attachable to the proximal end of the top portion when no aerosol-generating article is received in the cavity.

Example X: An aerosol-generating system comprising the device according to any one of Examples A to W and an aerosol-generating article comprising an aerosol-forming substrate.

The invention will be further described, by way of example only, with reference to the accompanying drawings in which.

Figure 1:
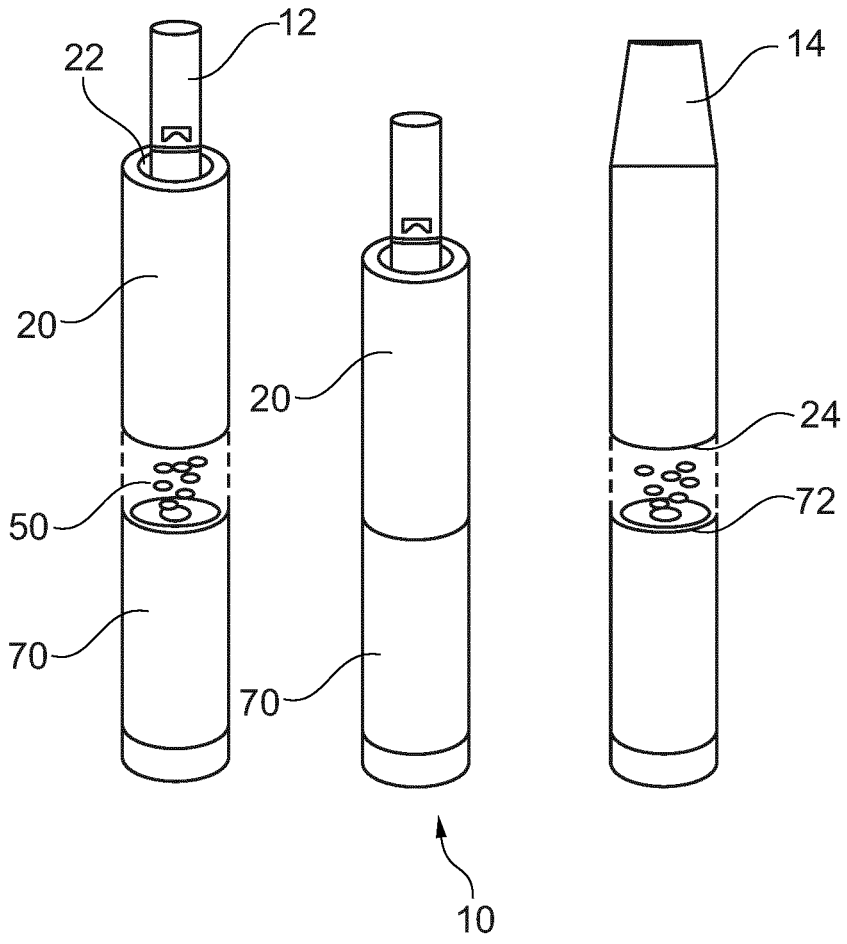
FIG. 1 shows an embodiment of an aerosol-generating device of the invention in three different modes of operation.

FIG. 1 shows an aerosol-generating device 10 of the invention in three different modes of operation. The aerosol-generating device 10 comprises a top portion 20 comprising a top housing and a heating element and a main portion 70 comprising a main housing and a power supply. The top portion 20 comprises a proximal end comprising a cavity 22 for receiving an aerosol-generating article 12, a distal end comprising a top cartridge connector 24, and a top airflow channel extending from the top cartridge connector 24 to the cavity 22. The main portion 70 comprises a proximal end comprising a main cartridge connector 72, a main air inlet (not shown) and a main airflow channel extending from the main air inlet to the main cartridge connector 72. As shown at the left-hand side of FIG. 1, the top cartridge connector 24 is removably attachable to a proximal end of a cartridge 50 and the main cartridge connector 74 is removably attachable to a distal end of a cartridge 50 enabling a first mode of operation. According to the first mode of operation, an inhalable aerosol may contain substances which are derived from the cartridge 50 and, additionally, substances derived from the aerosol-forming substrate comprised in the aerosol-generating article 12.

As shown in the middle of FIG. 1, the top cartridge connector 24 is also directly removably attachable to the main cartridge connector 72 enabling a second mode of operation. According to the second mode of operation, an inhalable aerosol may contain substances derived from the aerosol-forming substrate comprised in the aerosol-generating article 12, only.

As shown at the right-hand side of FIG. 1, the proximal end of the top portion is adapted to allow attachment of a mouthpiece 14 when no aerosol-generating article 12 is received in the cavity 22 enabling a third mode of operation. According to the third mode of operation, an inhalable aerosol may contain substances which are derived from the cartridge 50, only.

A user may choose between the different modes of operation. Thereby, a multi-functional aerosol-generating device 10 may be provided advantageously enabling three different modes of operations in one single device. Thus, it is not necessary for a user to carry three different devices for each mode of operation, but only one device. Also, a user may not need to buy three different devices, but only one device, which may be cost saving.

Figure 2:
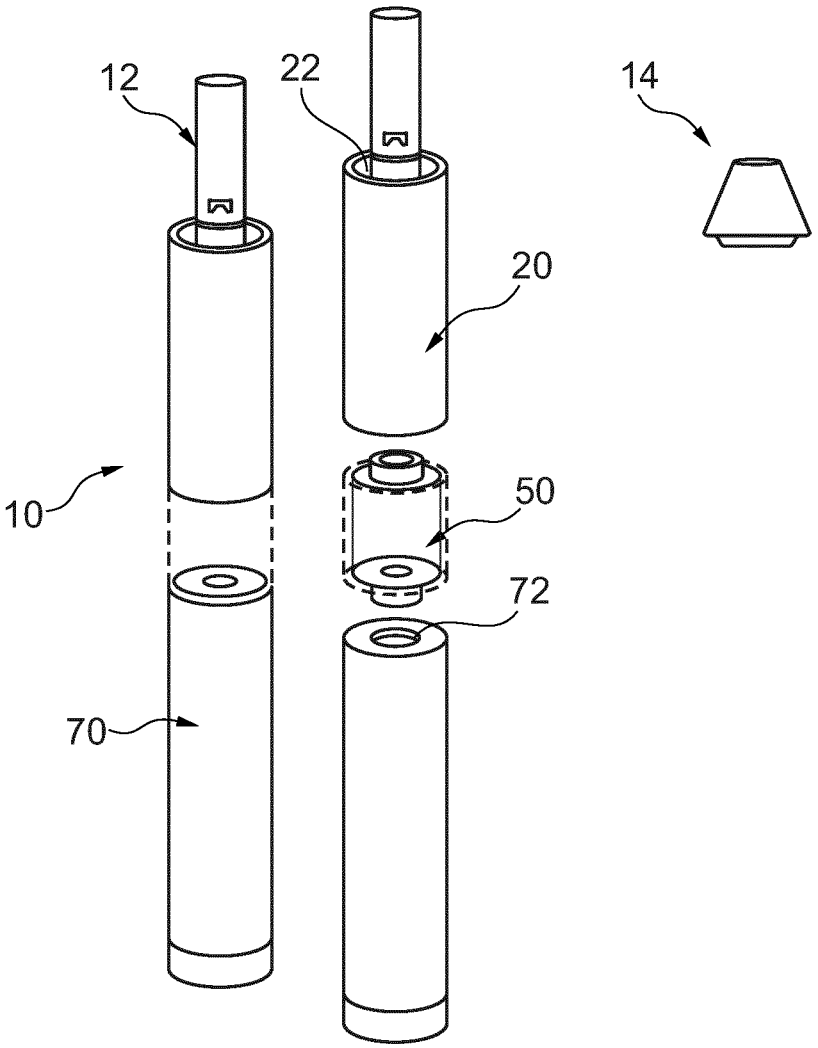
FIG. 2 shows an embodiment of an aerosol-generating device of the invention.

FIG. 2 shows an aerosol-generating device 10 of the invention. The left-hand side of FIG. 2 shows the aerosol-generating device 10 in an assembled state. An aerosol-generating article 12 is inserted into the cavity 22. The middle of FIG. 2 shows the aerosol-generating device 10 in an exploded view, wherein top portion 20, cartridge 50, and main portion 70 are not attached to each other. The distal end of the main portion 70 comprises a main cartridge connector 72 for removably attaching the main portion 70 to the cartridge 50. The proximal end of the top portion 20 comprises a corresponding top cartridge connector (not shown) for removably attaching the top portion 20 to the cartridge 50. The right-hand side of FIG. 2 shows an optional mouthpiece 14 which may be removably attached onto the cavity 22 when no aerosol-generating article 12 is inserted into the cavity 22.

Figure 3:
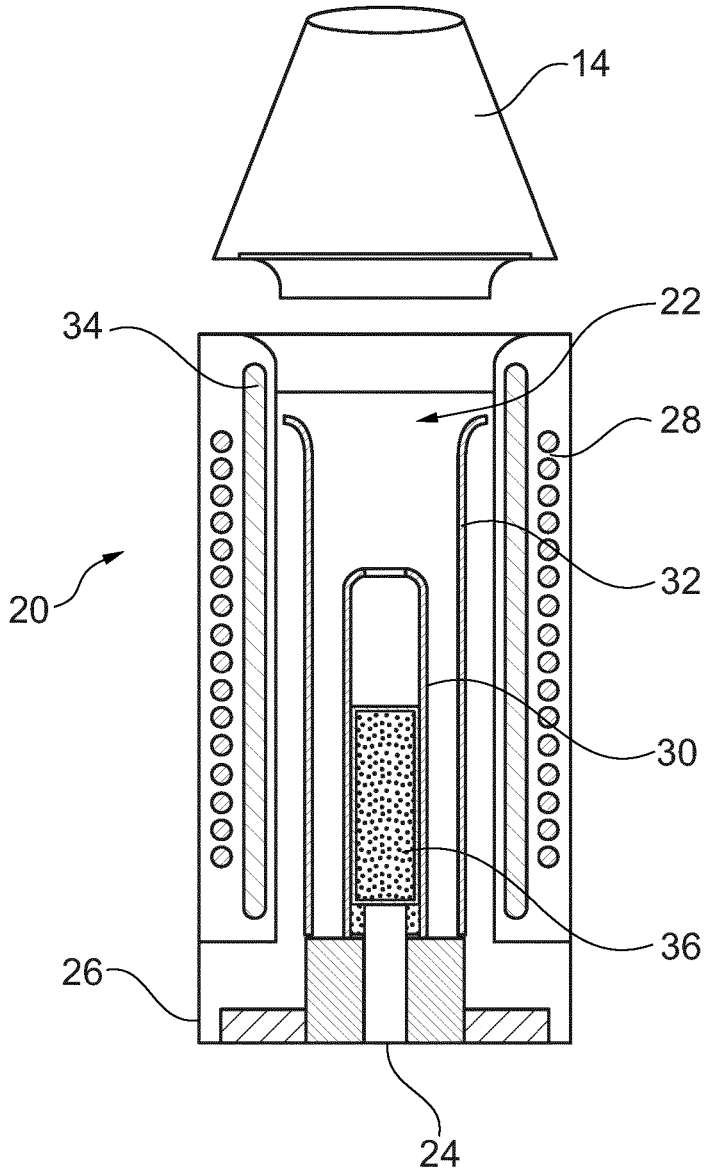
FIG. 3 shows a cross-section of a top portion of an embodiment of an aerosol-generating device of the invention.

FIG. 3 shows a cross-section of a top portion 20 of an aerosol-generating device 10 of the invention. The top airflow channel extends from the top cartridge connector 24 to the cavity 22. The top portion 20 further comprises a wick 36 being arranged within the top airflow channel. The wick 36 is arranged spaced from the top cartridge connector 24. The wick 36 is arranged spaced from the distal end of the top airflow channel.

The top portion 20 comprises a top air inlet 26, and an additional airflow channel extending from the top air inlet 26 to the cavity 22. The proximal end of the top portion 20 is adapted to allow reversible attachment of a mouthpiece 14 when no aerosol-generating article is received in the cavity enabling a third mode of operation. The heating element of the top portion 20 comprises an induction heating element. The induction heating element comprises a peripheral induction coil 28 and a tubular susceptor 30. The tubular susceptor 30 circumscribes a portion of the top airflow channel. The induction heating element further comprises an additional tubular susceptor 32. The additional tubular susceptor 32 circumscribes a portion of the cavity 22. The induction coil 28, the tubular susceptor 30, and the additional tubular susceptor 32 are coaxially aligned. Also shown is a thermal insulator 34 positioned between the induction coil 28, the additional tubular susceptor 32.

In an alternative embodiment of the embodiment of FIG. 3, instead of the induction heating element a resistive heating element is used. In the alternative embodiment, the induction coil 28 is omitted. Further in the alternative embodiment, the tubular susceptor 30 is replaced by a resistive heating tube of the same shape as the tubular susceptor 30 and the additional tubular susceptor 32 is replaced by an additional resistive heating tube of the same shape as the additional tubular susceptor 32. The resistive heating tube and the additional resistive heating tube may comprise flexible heating foils on a dielectric substrate, such as polyimide.

Figure 4:
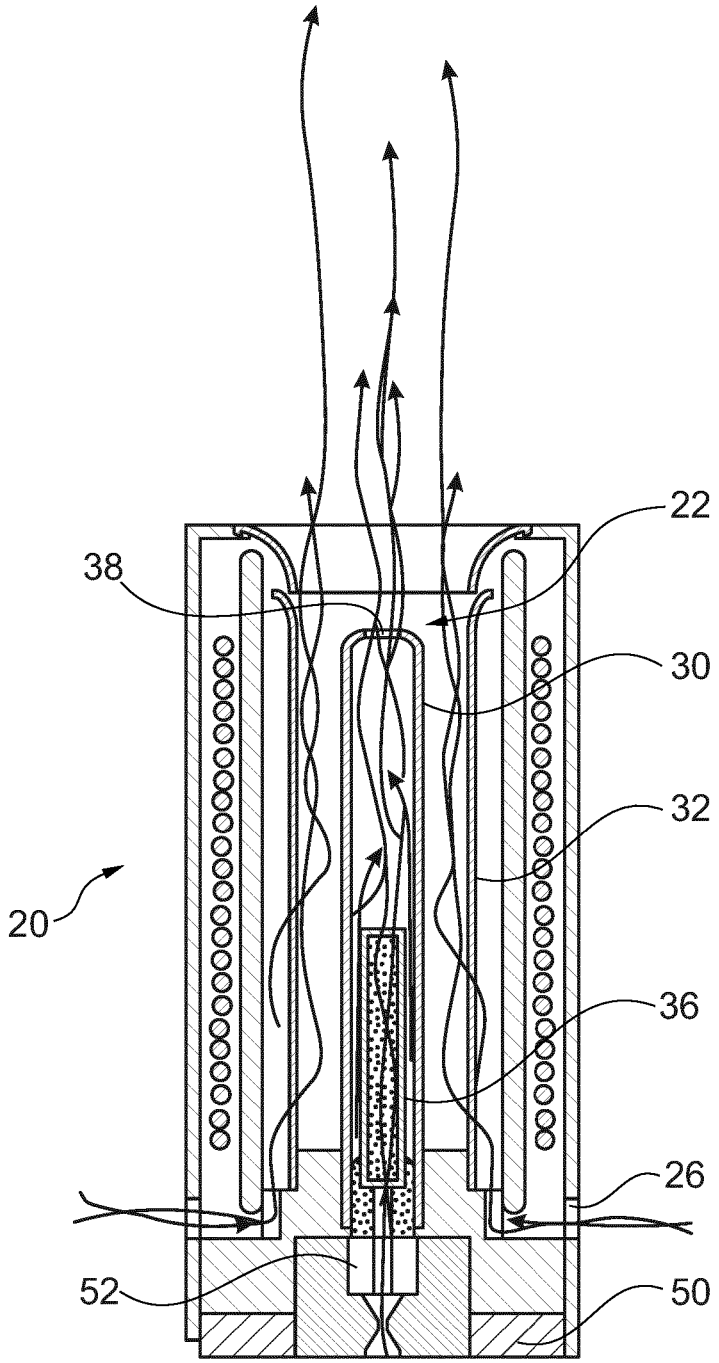
FIG. 4 shows a cross-section of a top portion of an embodiment of an aerosol-generating device of the invention.

FIG. 4 shows a cross-section of a top portion 20 of an aerosol-generating device 10 of the invention. Also shown in FIG. 4 is a proximal portion of a cartridge 50 being reversibly attached to the top portion 20. The liquid outlet 52 of the proximal end comprises a one-way valve. Meandering arrows indicate the airflow along the top airflow channel and along the additional airflow channel.

An aerosol-generating article to be inserted into the cavity 22 may comprise a hollow cylindrical tube comprising a solid aerosol-forming substrate at its distal end thereof and a mouthpiece including a mouthpiece filter at its proximal end thereof. The distal end of the aerosol-generating article may be inserted into the cavity 22 such that the hollow cylindrical tube is arranged between the tubular susceptor 30 and the additional tubular susceptor 32. The aerosol-generating article can thus be sandwiched between the two susceptors. The aerosol-generating article may be heated by the additional tubular susceptor 32. The aerosol-generating article may be additionally heated by the tubular susceptor 30.

The top air inlet 26 is fluidly connected with the cavity 22 along the additional airflow channel via apertures in the additional tubular susceptor 32. For example, the additional tubular susceptor 32 may comprise a plurality of separate heating blades arranged in a cylindrical configuration, and the space between neighbouring heating blades may define the apertures. The heating blades may comprise a susceptor material.

The top airflow channel extends within the hollow tube of the tubular susceptor 30. The wick 36 is placed within the tubular susceptor 30. The top airflow channel is fluidly connected with the cavity 22 via a top aperture 38 in the tubular susceptor 30.

Figure 5:
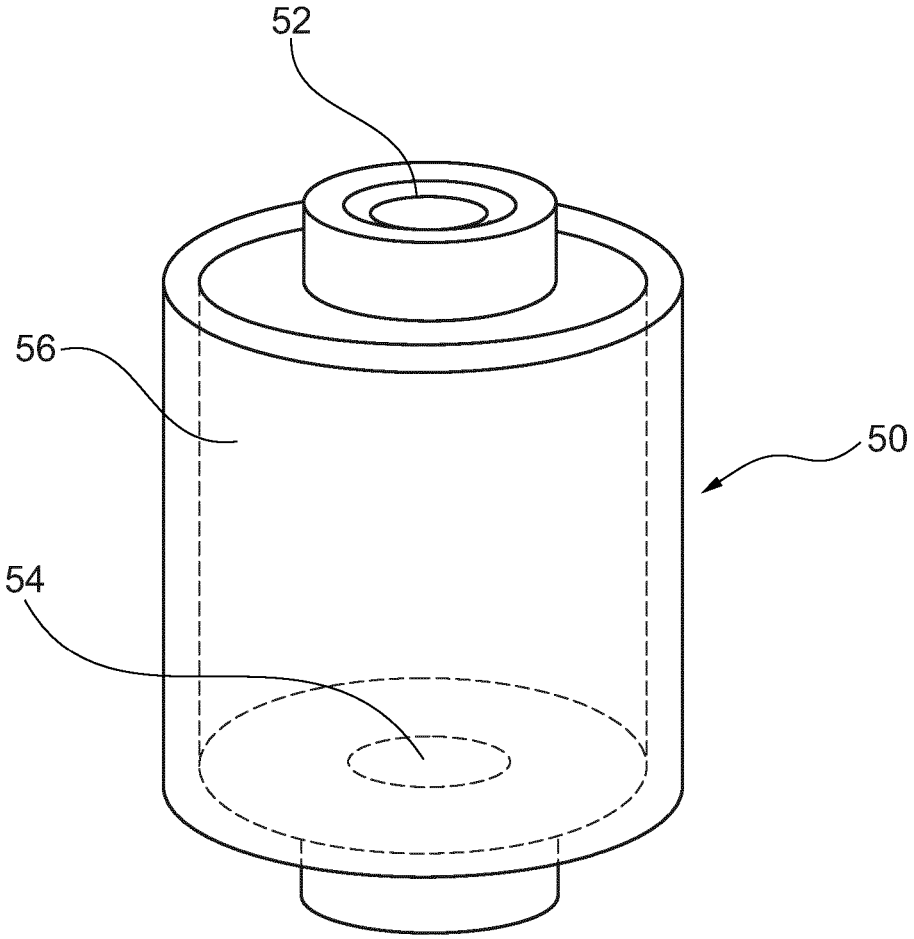
FIG. 5 shows an embodiment of a cartridge of the invention.

FIG. 5 shows a cartridge 50 of the invention for use with the aerosol-generating device 10 as described herein. The cartridge 50 comprises a proximal end comprising a liquid outlet 52 and being removably attachable to the top cartridge connector 24 of the top portion 20. The cartridge 50 comprises a distal end comprising an air inlet 54 and being removably attachable to the main cartridge connector 72 of the main portion 70. The cartridge 50 further comprises a liquid storage portion 56 arranged between the proximal end and the distal end, such that when the cartridge 50 is attached to both the top portion 20 and the main portion 70, a continuous fluid connection is provided along the main and top airflow channels from the main air inlet to the cavity 22 via the liquid storage portion 56 of the cartridge 50.

Figure 6:
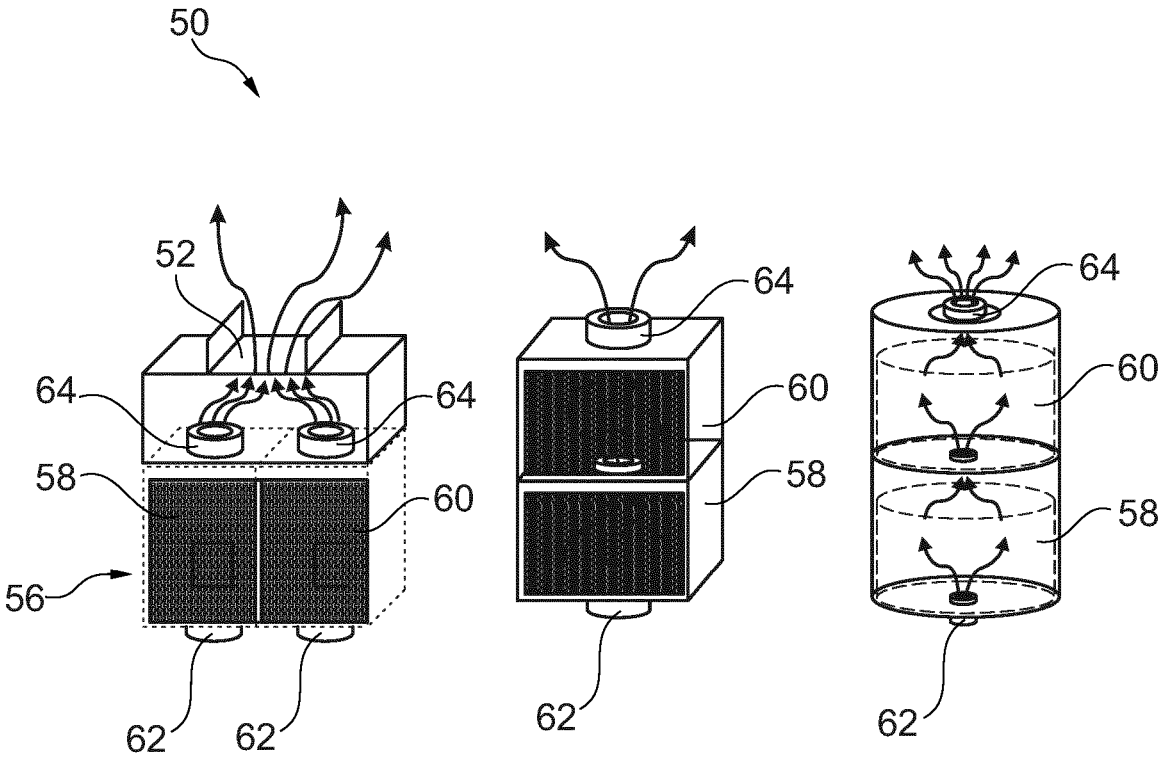
FIG. 6 shows three different embodiments of cartridges of the invention.

FIG. 6 shows three different cartridges 50 according to different embodiments of the invention. The cartridges 50 shown in FIG. 6 each comprise a liquid storage portion 56 comprising a first liquid storage compartment 58 and a second liquid storage compartment 60. The liquid storage portion 50 thus comprises two individual liquid storage compartments 58, 60. Both of the first and second liquid storage compartments 58, 60 comprise a compartment air inlet 62 and a compartment liquid outlet 64. The first liquid storage compartment 58 comprises a different liquid sensorial media compared to the second liquid storage compartment 60. Thus, the first liquid storage compartment 58 comprises a liquid composition which differs from the composition of second liquid storage compartment 60.

At the left-hand side of FIG. 6, a cartridge 50 is shown comprising two parallel-connected liquid storage compartments 58, 60 such that, when the cartridge 50 is attached to both the top portion and the main portion, a continuous fluid connection is provided along the main and top airflow channels from the main air inlet to the cavity via the parallel-connected liquid storage compartments 58, 60 of the liquid storage portion 56 of the cartridge 50. An airflow exiting both the compartment liquid outlets 64 of each of the parallel-connected liquid storage compartments 58, 60 may mix in an upstream mixing region before exiting the cartridge 50 via the liquid outlet 52.

Alternatively, additional means may be comprised for selectively providing a continuous fluid connection along the main and top airflow channels from the main air inlet to the cavity via only one of the two liquid storage compartments 58, 60, when the cartridge is attached to both the top portion and the main portion. For example, individually controllable shutters may be provided at the compartment air inlets 62 and, alternatively or in addition, at the compartment liquid outlets 64 of one or both of the individual liquid storage compartment 58, 60. A user may choose between the parallel-connected liquid storage compartments 58, 60 to provide the fluid connection.

The compartment air inlets 62 may, at the same time, serve as the air inlet 54 of the cartridge 50.

The middle of FIG. 6 shows an embodiment of the cartridge 50 comprising two individual liquid storage compartments 58, 60 in another configuration. The two liquid storage compartments 58, 60 are series-connected such that, when the cartridge is attached to both the top portion and the main portion, a continuous fluid connection is provided along the main and top airflow channels from the main air inlet to the cavity via the liquid storage portion of the cartridge. The compartment liquid outlet 64 of the first liquid storage compartment 58 is fluidly connected to the compartment air inlet 62 of the second liquid storage compartment 60. The fluid connection is thus provided subsequently through the two series-connected liquid storage compartments 58, 60 of the liquid storage portion 56 of the cartridge 50.

The compartment air inlet 62 of the first liquid storage compartment 58 may, at the same time, serve as the air inlet 54 of the cartridge 50. The compartment liquid outlet 64 of the second liquid storage compartment 60 may, at the same time, serve as the liquid outlet 52 of the cartridge 50.

The right-hand side of FIG. 6 similarly shows an embodiment with two series-connected liquid storage compartments 58, 60. However, both the first and second the liquid storage compartments 58, 60 have a cylindrical shape such that a cylindrical shape of the liquid storage portion 56 and of the cartridge 50 results.

Figure 7:
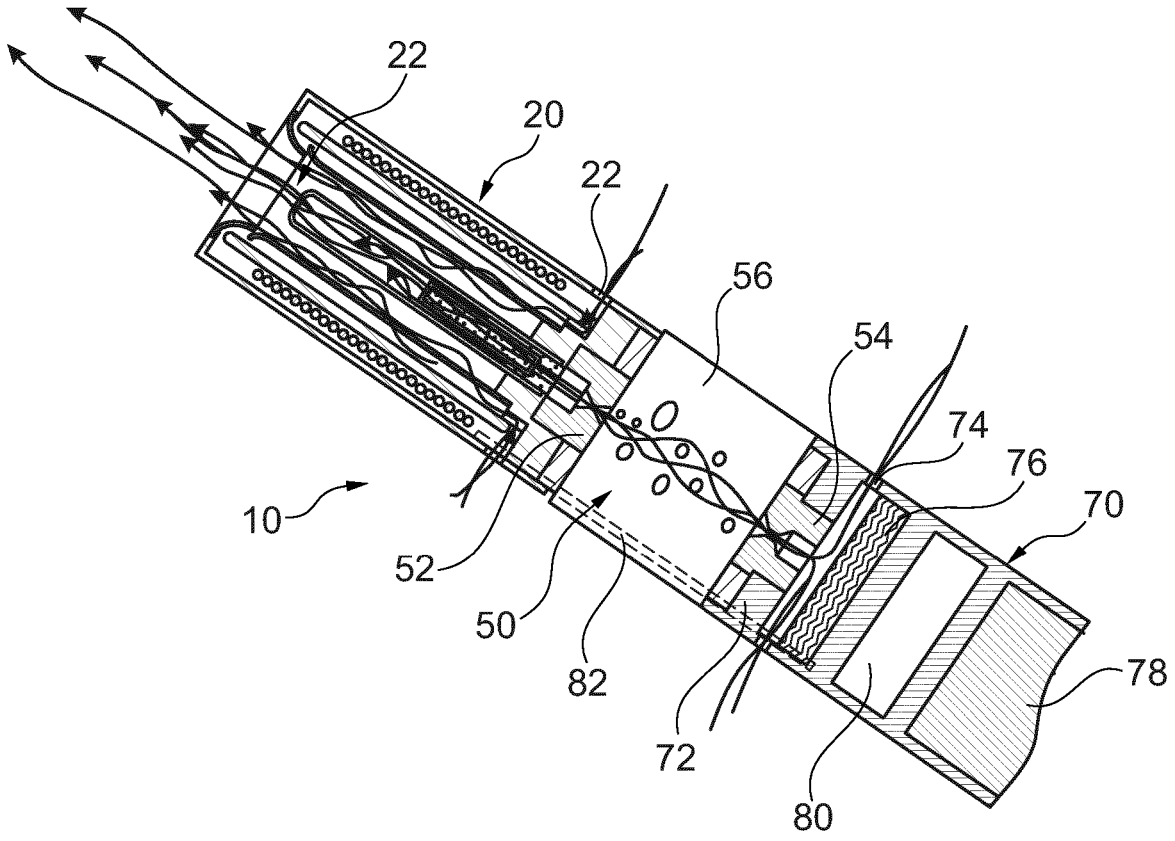
FIG. 7 shows a cross-section of an embodiment of an aerosol-generating device of the invention.

FIG. 7 shows a cross-section of an aerosol-generating device 10 of the invention. The aerosol-generating device 10 comprises a top portion 20 and a main portion 70. A cavity 22 for receiving an aerosol-generating article (not shown) is provided in the top portion 20. A cartridge 50 is connected to the aerosol-generating device 10. The cartridge 50 is arranged between the top portion 20 and the main portion 70. Top portion 20 of FIG. 7 corresponds to top portion 20 of the embodiment of FIG. 4.

The main portion 70 comprises a main air inlet 74 and is attached to the cartridge 50 via the main cartridge connector 72. The main portion 70 comprises a high retention material 76 being arranged in proximity to the air inlet 54 of the cartridge 50 for absorbing potential leaks of the cartridge 50. The main portion 70 further comprises a power supply 78 for powering the heating element in the top portion 20. Electrically connected to the power supply 78, the main portion 70 further comprises a controller 80 for controlling the power supply 78. Additionally, the aerosol-generating device 10 comprises electrically conductive elements 82 being adapted to establish electric contact between the top portion 20 and the main portion 70 when the cartridge 50 is attached to both the top portion 20 and the main portion 70 and when the top portion 20 is directly attached to the main portion 70. Electrically conductive elements 82 are provided in both the top portion 20, the main portion 70, and the cartridge 50. The electrically conductive elements 82 connect the heating element in the top portion 20 to the controller 80 and the power supply 78 in the main portion 70.

The aerosol-generating device 10 provides different routes for the airflow as indicated by meandering arrows in FIG. 7. First and second routes for the airflow extend along the top airflow channel and the additional airflow channel as shown and explained above with respect to the top portion of FIG. 4. A third airflow route extends along a main airflow channel extending from the main air inlet 74 to the main cartridge connector 72. The third airflow route further extends through the liquid contained in the liquid storage portion 56. By means of the third airflow route extraction of liquid from the liquid storage portion 56 via the liquid outlet 52 may be advantageously promoted.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A ±five percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating device comprising a top portion, a main portion, and a cartridge, the top portion comprising:

a top housing, a heating element, a proximal end comprising a cavity for receiving an aerosol-generating article, a distal end comprising a top cartridge connector, and a top airflow channel extending from the top cartridge connector to the cavity;

the main portion comprising:

a main housing, a power supply, a proximal end comprising a main cartridge connector, a main air inlet, and a main airflow channel extending from the main air inlet to the main cartridge connector;

the cartridge comprising:

a proximal end comprising a liquid outlet, a distal end comprising an air inlet, and a liquid storage portion arranged between the proximal end and the distal end;

wherein the top cartridge connector of the top portion is removably attachable to the proximal end of the cartridge and the main cartridge connector of the main portion is removably attachable to the distal end of the cartridge such that when the cartridge is attached to both the top portion and the main portion, a continuous airflow route in fluid connection is provided along the main and top airflow channels from the main air inlet to the cavity through the liquid contained in the liquid storage portion of the cartridge enabling a first mode of operation, and wherein the top cartridge connector is directly removably attachable to the main cartridge connector enabling a second mode of operation.

2. The device according to claim 1, wherein the top portion comprises a top air inlet, and an additional airflow channel extending from the top air inlet to the cavity.

3. The device according to claim 1, wherein the proximal end of the top portion is adapted to allow attachment of a mouthpiece when no aerosol-generating article is received in the cavity enabling a third mode of operation.

4. The device according to claim 1, further comprising a mouthpiece, wherein the mouthpiece is removably attachable to the proximal end of the top portion when no aerosol-generating article is received in the cavity.

5. The device according to claim 1, wherein both the top cartridge connector and the main cartridge connector comprise electrically conductive elements being adapted to establish electric contact between the top portion and the main portion when the top cartridge connector is directly attached to the main cartridge connector according to the second mode of operation.

6. The device according to claim 1, wherein the heating element of the top portion comprises an induction heating element.

7. The device according to claim 6, wherein the induction heating element comprises a peripheral induction coil and a tubular susceptor, the tubular susceptor circumscribing at least a portion of the top airflow channel.

8. The device according to claim 7, wherein the top portion comprises a top air inlet, and an additional airflow channel extending from the top air inlet to the cavity; and wherein the induction heating element comprises an additional tubular susceptor, the additional tubular susceptor circumscribing at least a portion of the cavity.

9. The device according to claim 8, wherein the induction coil, the tubular susceptor, and the additional tubular susceptor are coaxially aligned.

10. The device according to claim 1, wherein the top portion comprises a wick being arranged at least partly within the top airflow channel, and wherein the wick is arranged spaced from the distal end of the top airflow channel.

11. The device according to claim 10, wherein the wick is a porous element.

12. The device according to claim 1, wherein the main portion comprises a high retention material being arranged in proximity to the main cartridge connector for absorbing potential leaks of the cartridge.

13. The device according to claim 1, wherein the liquid outlet of the proximal end of the cartridge comprises a one-way valve.

14. The device according to claim 1, wherein the air inlet of the distal end of the cartridge comprises a one-way valve.

15. The device according to claim 1, wherein the liquid storage portion of the cartridge comprises a liquid sensorial media.

16. The device according to claim 15, wherein the liquid sensorial media comprises a flavorant.

17. The device according to claim 15, wherein the liquid sensorial media comprises nicotine.

18. The device according to claim 1, wherein the liquid storage portion of the cartridge comprises two or more series-connected liquid storage compartments.

19. The device according to claim 1, wherein the liquid storage portion of the cartridge comprises two or more parallel-connected liquid storage compartments.

20. The device according to claim 18, wherein at least one liquid storage compartment comprises a liquid composition which differs from a liquid composition of another liquid storage compartment.

21. The device according to claim 1, wherein the cartridge comprises electrically conductive elements being adapted to establish electric contact between the top portion and the main portion when the cartridge is attached to both the top portion and the main portion.

22. An aerosol-generating system comprising the device according to claim 1 and an aerosol-generating article comprising an aerosol-forming substrate.

* * * * *